US011796268B2

(12) United States Patent
Hoffman et al.

(10) Patent No.: US 11,796,268 B2
(45) Date of Patent: Oct. 24, 2023

(54) PRESSURE DISCRIMINATING CARTRIDGE CHAMBER

(71) Applicant: The United States of America, as represented by the Secretary of the Navy, Crane, IN (US)

(72) Inventors: Brian R Hoffman, Bloomington, IN (US); Caleb W McGee, Bloomington, IN (US); John David Lawrence, Bloomington, IN (US); Calvin Tyler Lawson, Springville, IN (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/375,072

(22) Filed: Jul. 14, 2021

(65) Prior Publication Data

US 2022/0057159 A1 Feb. 24, 2022

Related U.S. Application Data

(60) Provisional application No. 63/064,525, filed on Aug. 12, 2020.

(51) Int. Cl.
*F41A 21/12* (2006.01)
*F41A 17/34* (2006.01)

(52) U.S. Cl.
CPC ..... *F41A 17/34* (2013.01); *F41A 21/12* (2013.01)

(58) Field of Classification Search
CPC ..... F41A 21/12; F41A 21/26; F41A 21/28
See application file for complete search history.

(56) References Cited

U.S. PATENT DOCUMENTS 1,028,358 A * 6/1912 Johnson ..... F41A 21/12 42/76.01
1,028,430 A * 6/1912 Burton ..... F41A 21/16 42/76.01

(Continued)

FOREIGN PATENT DOCUMENTS

CA 2189904 A1 * 5/1998
DE 2606016 A1 * 8/1977

(Continued)

*Primary Examiner* — Gabriel J. Klein
(74) *Attorney, Agent, or Firm* — Naval Surface Warfare Center, Crane Division; Christopher Feigenbutz

(57) ABSTRACT

Provided is a firearm cartridge chamber with a relief feature that traps a portion of a cartridge case within the cartridge chamber when fired. The relief feature causes the cartridge case to deform within the chamber, wherein it optionally separates into a forward section and a rearward section. The deformed case remains trapped after firing, preventing extraction of the fired case and the chambering or firing of any subsequent cartridges, thereby causing a firearm malfunction. The cartridge chamber can distinguish between higher and lower pressure cartridges by allowing for normal firing and function with blank training ammunition while also facilitating localized deformation of the cartridge case when firing standard ammunition that includes one or more projectiles. The inventive chamber prevents more than one higher pressure round from firing while allowing lower pressure or training rounds to fire without limitation, which aids in enhanced safety during training exercises.

15 Claims, 7 Drawing Sheets

(56) References Cited

U.S. PATENT DOCUMENTS

| | | | | | |
|---|---|---|---|---|---|
| 1,864,374 | A * | 6/1932 | Schuler | F41A 1/06 | 42/76.01 |
| 2,880,543 | A * | 4/1959 | Von Frantzius | F41H 9/10 | 42/76.01 |
| 2,925,014 | A * | 2/1960 | Abramson | F41A 21/12 | 42/76.01 |
| 3,059,367 | A * | 10/1962 | Ward | F41A 21/28 | 89/14.05 |
| 3,609,904 | A * | 10/1971 | Scanlon | F41A 15/04 | 102/466 |
| 3,837,108 | A * | 9/1974 | Seitz | F41A 21/28 | 42/76.01 |
| 4,969,283 | A * | 11/1990 | Baehr | F41A 21/00 | 42/76.01 |
| 5,740,626 | A | 4/1998 | Schuetz et al. | | |
| 8,683,728 | B2 | 4/2014 | Inskeep et al. | | |
| 9,188,402 | B2 | 11/2015 | Giannini et al. | | |
| 2005/0188830 | A1 * | 9/2005 | Gee | F41A 21/28 | 89/14.5 |
| 2022/0099400 | A1 * | 3/2022 | Speichinger | F41A 21/26 | |

FOREIGN PATENT DOCUMENTS

| | | | | |
|---|---|---|---|---|
| DE | 202008009989 | U1 * | 12/2008 | F41A 21/12 |
| FR | 478525 | A * | 12/1915 | |
| WO | WO-2016125129 | A1 * | 8/2016 | |

* cited by examiner

PRESSURE DISCRIMINATING CARTRIDGE CHAMBER

CROSS-REFERENCE TO RELATED APPLICATIONS

The present application claims priority to U.S. Provisional Patent Application Ser. No. 63/064,525, filed Aug. 12, 2020, entitled "Pressure Discriminating Cartridge Chamber," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200637US02) is assigned to the United States Government and is available for licensing for commercial purposes. Licensing and technical inquiries may be directed to the Technology Transfer Office, Naval Surface Warfare Center Crane, email: Cran_CTO@navy.mil.

FIELD OF THE INVENTION

The present invention relates generally to safety mechanisms for preventing rifles from firing live ammunition. More particularly, it pertains to a cartridge chamber with a relief feature that traps a portion of a cartridge case within the cartridge chamber when a high power cartridge is fired, while operating normally when a low power cartridge is fired.

BACKGROUND

During force on force training exercises, negligent discharges of live rounds are periodically encountered that can lead to injury or death. It is also possible that someone would intentionally attempt to load and fire live rounds during a training scenario with the intent to do harm. There is a need for a blank firing only training system that increases safety by successfully addressing the scenario of a negligent or intentional discharge of a standard combat cartridge in the training weapon.

Previous attempts to provide such a system fail to prevent multiple live rounds from firing. Prior methods of discouraging the firing of standard combat ammunition in training weapons include cartridge feeding discriminators (such as modified magazines or feed trays), custom barrels with unique chambers and unique blank training ammunition, physical impediments in the barrel to prevent chambering of standard combat cartridges (such as U.S. Pat. Nos. 8,683,728 and 9,188,402), and various gas venting methods (such as U.S. Pat. No. 5,740,626) that attempt to slow down or prevent the bullet from a standard combat cartridge from exiting the barrel. With exception to a custom barrel and unique cartridge chamber with unique blank ammunition (of a non-standard configuration), the other proposed solutions are not completely reliable. At a minimum, they do not prevent the deliberate action of hand loading and firing more than one standard combat cartridge. Even the solutions that suggest a physical impediment just forward of the cartridge chamber (to interfere with the bullet of an incoming standard combat cartridge) do not always reliably induce the desired effect and will sometimes allow for the bullet to be farther seated within the cartridge case during chambering and still be fired.

Methods such as gas venting are also problematic in that these solutions allow for the possibility of bullet stack-up to occur within the barrel, which can lead to dramatic overpressure situations and catastrophic failure. This can lead to safety risks for both the operator and those who may be in close proximity. While solutions relying on custom barrels with unique cartridge chambers and unique ammunition can prevent the chambering of standard combat ammunition, these solutions are costly and inherently demand dependence on unique and often proprietary, non-standard blank cartridges. This drives up lifecycle costs and introduces unwanted logistics and acquisition challenges in order to fund and maintain the required barrel and ammunition inventories.

SUMMARY OF THE INVENTION

The present invention relates to a pressure discriminating cartridge chamber that prevents more than one high power or standard combat rounds from firing and allows low power or training rounds to fire without limitation. The inventive item, named the Pressure Discriminating Cartridge Chamber (PDCC), provides utility benefit to a class of training weapons by way of increased safety to downrange participants as well as the operator of the training weapon. The benefit is realized in the event that a standard combat cartridge is mistakenly or intentionally loaded and fired during a training event meant only for the firing of blank training ammunition. The inventive cartridge chamber passively and instantaneously discriminates between the different types of cartridges being fired (e.g., standard combat vs blank training) by leveraging the significant peak pressure difference that exists between the two general types of ammunition. When blank training ammunition is used, which operates at a relatively low peak pressure, a training weapon with the inventive cartridge chamber functions normally as if the blank training ammunition were being loaded and fired in a conventional cartridge chamber.

The blank or training rounds do not behave any differently in the inventive cartridge chamber. However, if standard combat ammunition is used, which operates at a much higher peak pressure, a specially designed relief feature of the inventive cartridge chamber facilitates localized material deformation or failure of the fired cartridge case. This deliberate material deformation traps a portion of the fired case in the inventive chamber, which results in a severe weapon malfunction that is not correctable by the operator. The malfunction and trapped portion of the previously fired cartridge case serves as a physical impediment, preventing the chambering or firing of any subsequent cartridges. Effectively, the weapon is no longer usable and therefore unable to fire additional cartridges.

According to an illustrative embodiment of the present disclosure, it is an object of the present invention to limit the number of fired standard combat cartridges to just one before rendering the training weapon inoperable for further use.

According to a further illustrative embodiment of the present disclosure, it is an object of the present invention to prevent the possibility for bullet stack-up and related overpressure concerns of firing multiple standard combat cartridges, thereby also increasing safety to the operator of the training weapon and those in close proximity.

According to another illustrative embodiment of the present disclosure, it is an object of the present invention to prevent the need for dependence on non-standard blank ammunition with the use of a device that remains compatible with standard inventory blank ammunition.

According to a final illustrative embodiment of the present disclosure, it is an object of the present invention to provide a simple, cost-effective, and logistically desirable solution for the training community.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Generally, the invention relates to a firearm cartridge chamber with a circumferentially relief feature incorporated integrally or non-integrally into the cartridge chamber that forms a cavity where there is no contact between the chamber and the cartridge. A portion of the cartridge case deforms and fills the cavity when the cartridge is fired. The relief feature permits the cartridge case to deform within the cartridge chamber, wherein it separates into a forward section and a rearward section. The forward section remains trapped after case extraction, preventing the chambering or firing of any subsequent cartridges, thereby causing a firearm malfunction. The cartridge chamber can distinguish between high and low pressure cartridges by allowing for normal firing and function with blank training ammunition while also facilitating localized deformation of said cartridge case when firing standard combat ammunition. The inventive chamber prevents more than one high pressure round from firing while allowing low pressure or training rounds to fire without limitation, which aids in enhanced safety during training exercises.

Figure 1A:
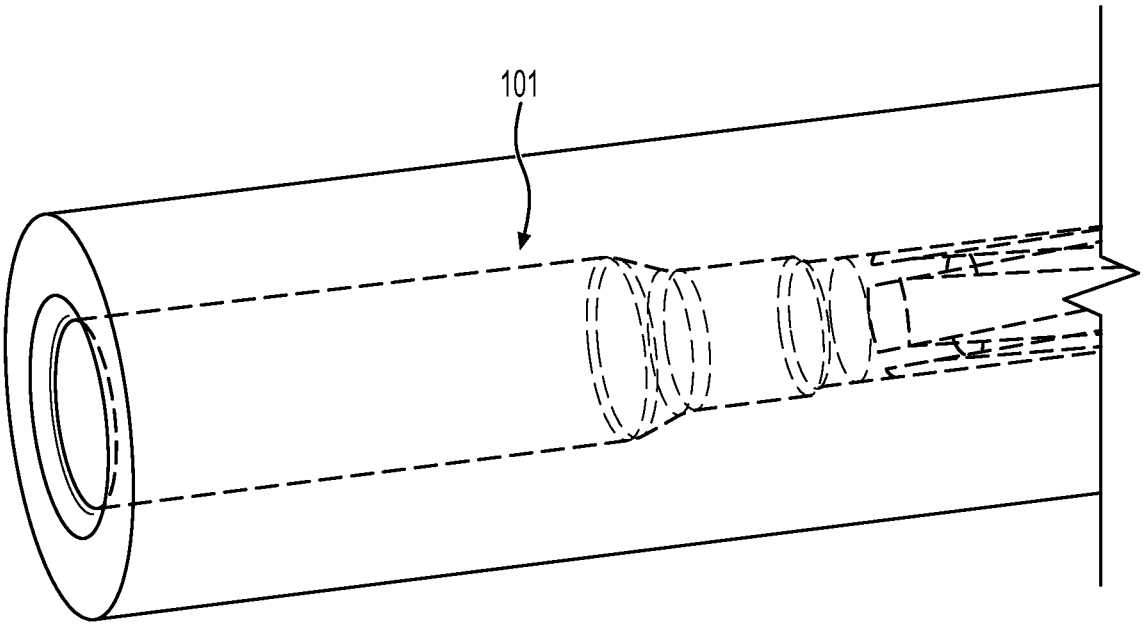
FIG. 1A PRIOR ART
FIG. 1A shows a perspective view of the interior of a prior art cartridge chamber.
Figure 1B:
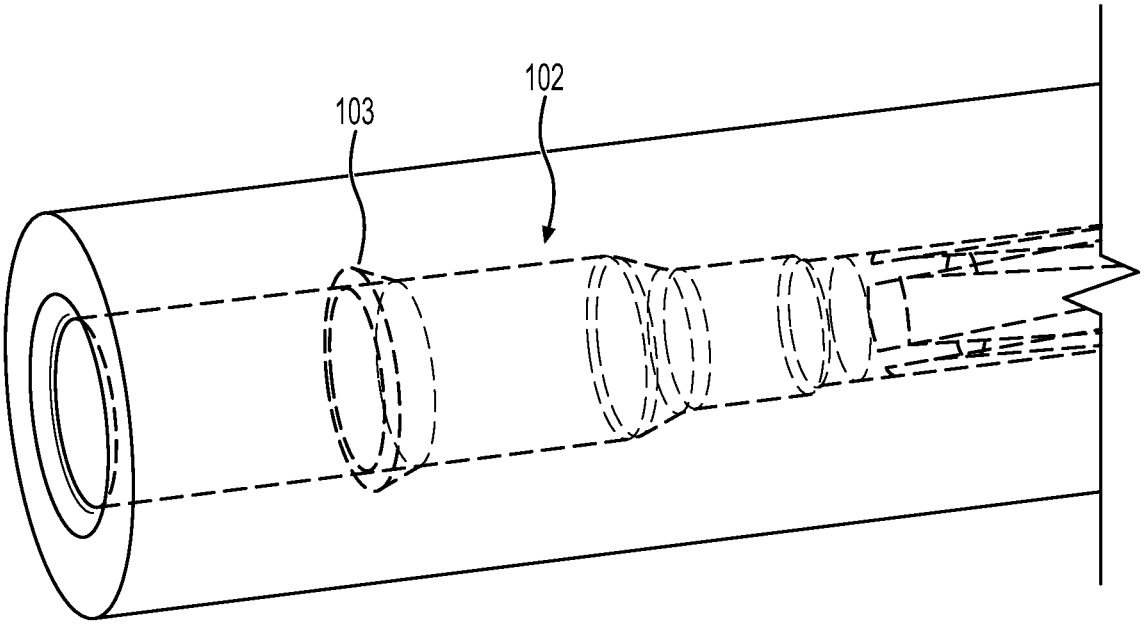
FIG. 1B shows a perspective view of the interior of the inventive cartridge

FIG. 1A shows a perspective view of the interior of a prior art cartridge chamber 101, while FIG. 1B shows a perspective view of the interior of the inventive cartridge chamber 102. The inventive chamber 102 resembles a prior art cartridge chamber 101 with the addition of a relief feature 103 therein that causes deformation to a full power (referred to interchangeably as a high or standard combat) cartridge case when fired, which will be shown and described in greater detail below. As is well understood, a chamber is designed to snugly support a chambered cartridge so that when fired, substantially all of the force produced by the propellant within the cartridge cause the projectile (bullet, shot, round, and the like) to be expelled through the barrel and out of the firearm. In the instant invention, however, the relief feature 103 provides an area where the cartridge case is not supported. The pressure from the fired cartridge causes the case to deform and to fill in the relief feature 103, causing a portion of the cartridge to remain within the chamber 102.

Figure 2A:
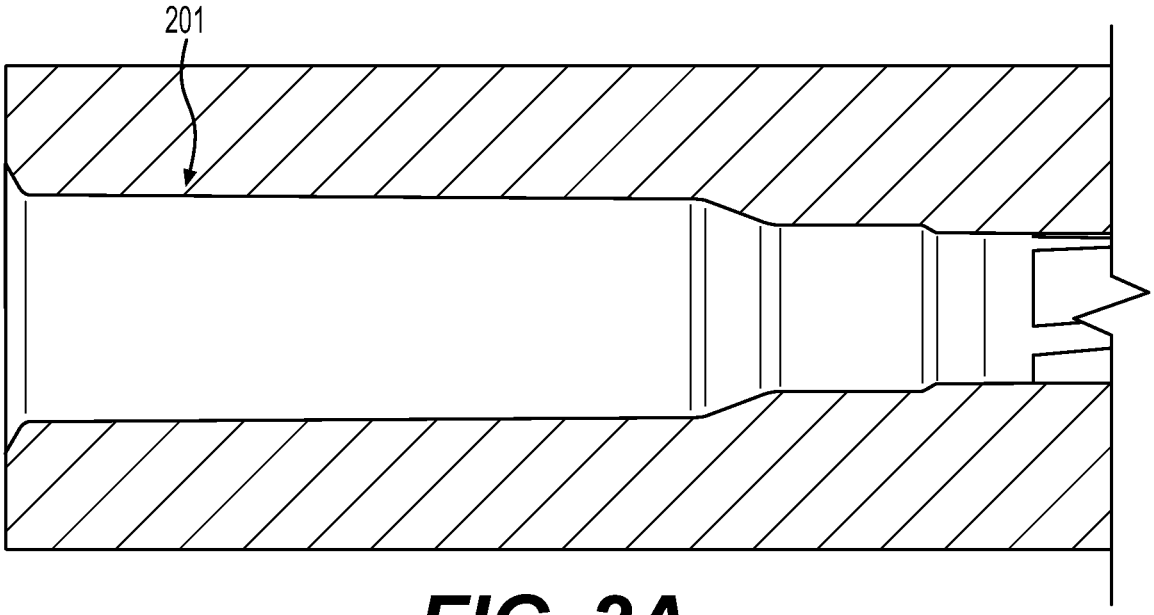
FIG. 2A PRIOR ART
FIG. 2A shows a side section view of a prior art cartridge chamber.
Figure 2B:
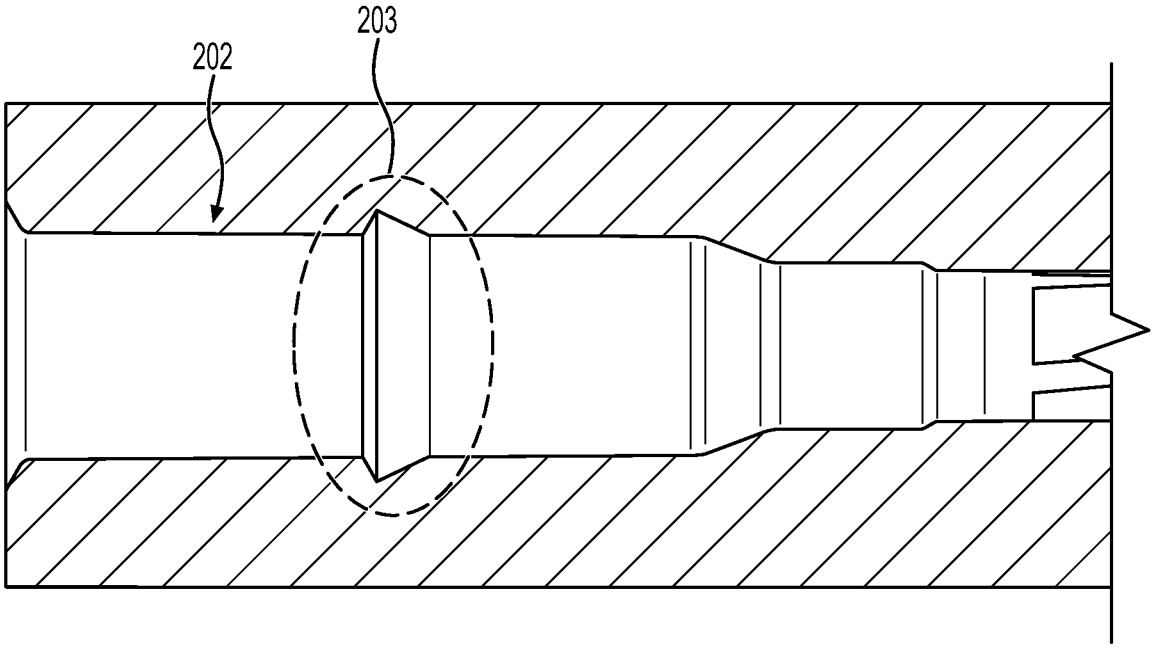
FIG. 2B shows a side section view of the inventive cartridge chamber.

FIG. 2 shows a side section view of a prior art cartridge chamber 201, while FIG. 2B shows a side section view of the inventive cartridge chamber 202. The preferred embodiment of the inventive cartridge chamber involves a circumferentially machined relief feature 201 incorporated integrally into an existing cartridge chamber of a firearm barrel. The relief feature 203 may be located and sized appropriately via engineering design and analysis to allow for normal firing and function with blank training ammunition while also facilitating localized deformation of the cartridge case body when firing standard combat ammunition.

Figure 3:
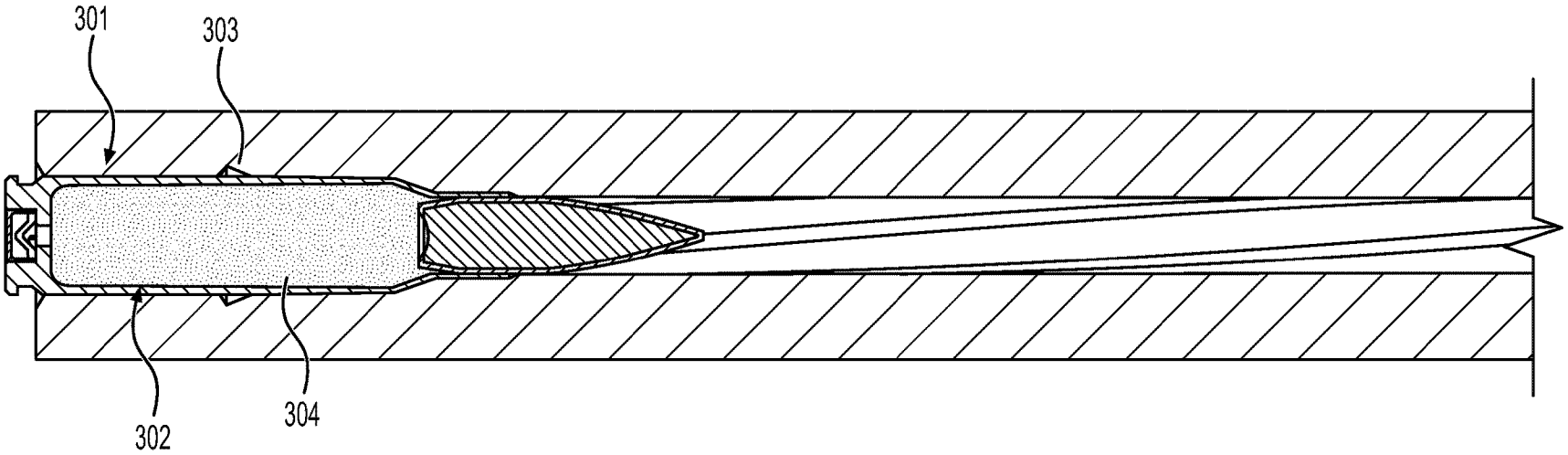
FIG. 3 shows a side section view of a standard cartridge chambered in the inventive chamber before firing.

FIG. 3 shows a side section view of a standard cartridge 302 chambered in the inventive chamber 301 before firing. The cartridge 302 fits snugly within the chamber 301, however, the relief feature 303 creates a cavity within the chamber 301 where there is no structural support between the chamber 301 and the cartridge 302. As will be shown in greater detail below, when a low pressure cartridge, such as a training or blank ammunition cartridge (not shown) is fired within the inventive chamber 301, the pressure created by firing does not cause deformation of the cartridge case, allowing the firearm to operate normally. When a full power cartridge 302 is fired, however, the pressure causes the cartridge case 304 to fill the cavity formed by the relief 303.

Figure 4:
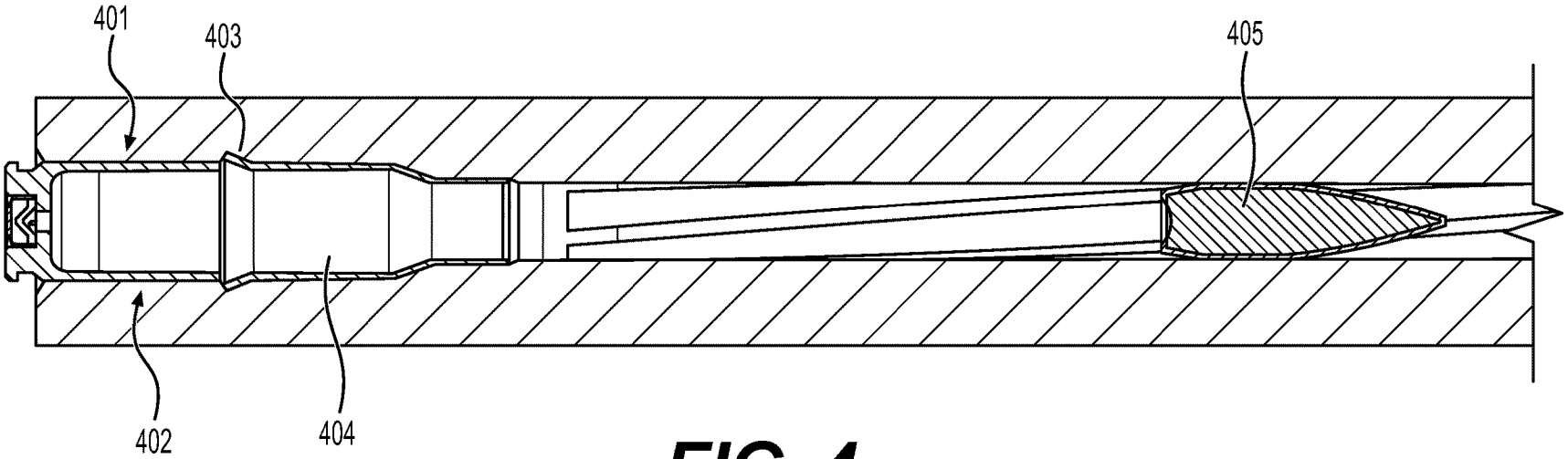
FIG. 4 shows a side section view of a standard cartridge case in the inventive chamber after firing.

FIG. 4 shows a side section view of a standard cartridge case 402 in the inventive chamber 401 after firing. When a full power cartridge 402 is fired and the bullet 405 is released from the cartridge casing 404, the pressure exerted on the cartridge casing 404 by the propellant contained within the cartridge 402 causes the casing 404 to deform and to fill the cavity created by the relief feature 403.

Figure 5:
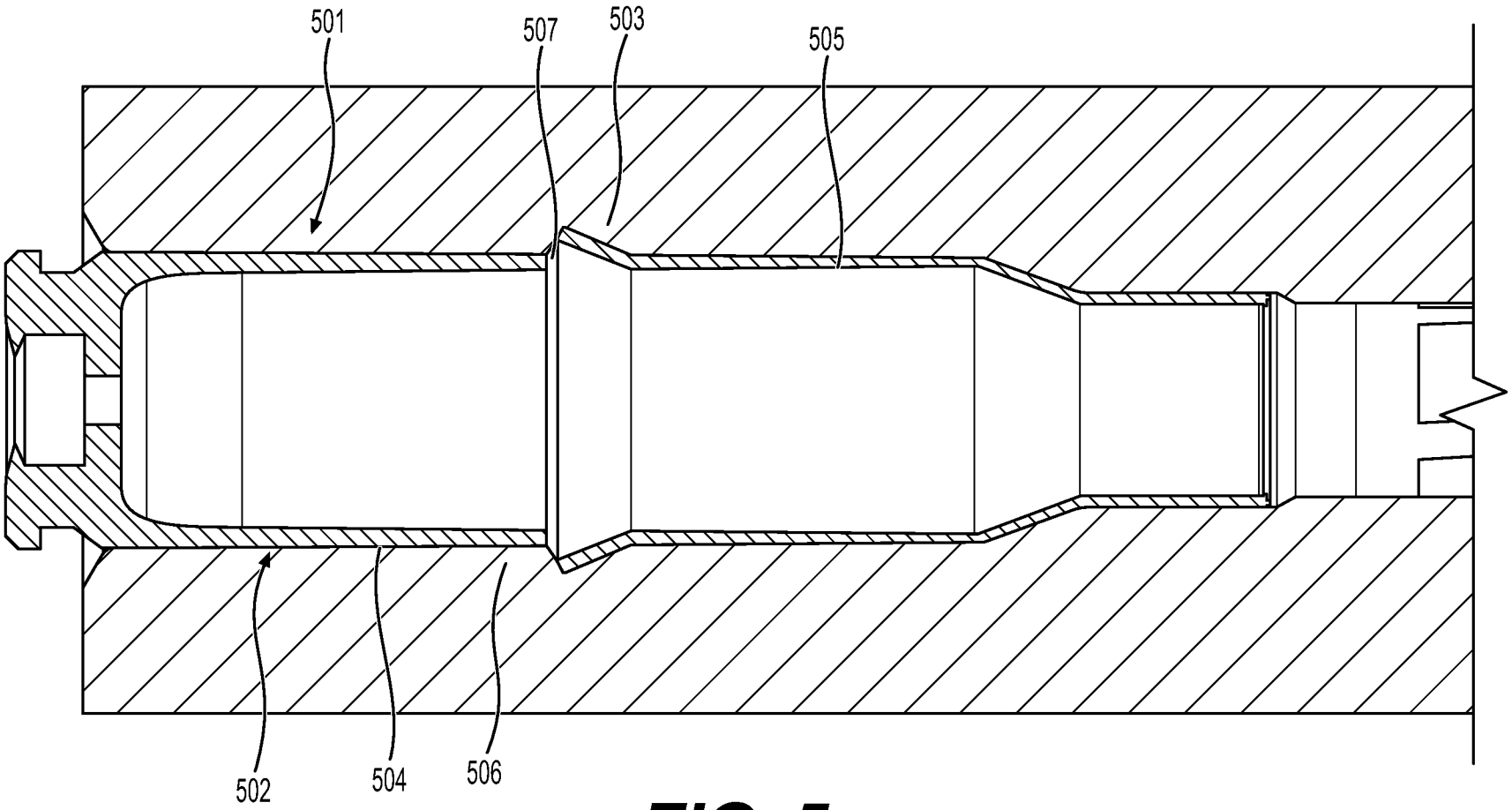
FIG. 5 shows a close-up side section view of standard cartridge case in the inventive chamber after firing.

FIG. 5 shows a close-up side section view of standard cartridge case 502 in the inventive chamber 501 after firing. When the cartridge casing 504 deforms into the relief feature 503, it causes the cartridge casing 504 to break into two sections, leaving the forward section of the case 505 separated entirely from the rearward section of the case 506, with the separation point 507 being at the proximal end of the relief feature 503.

Figure 6:
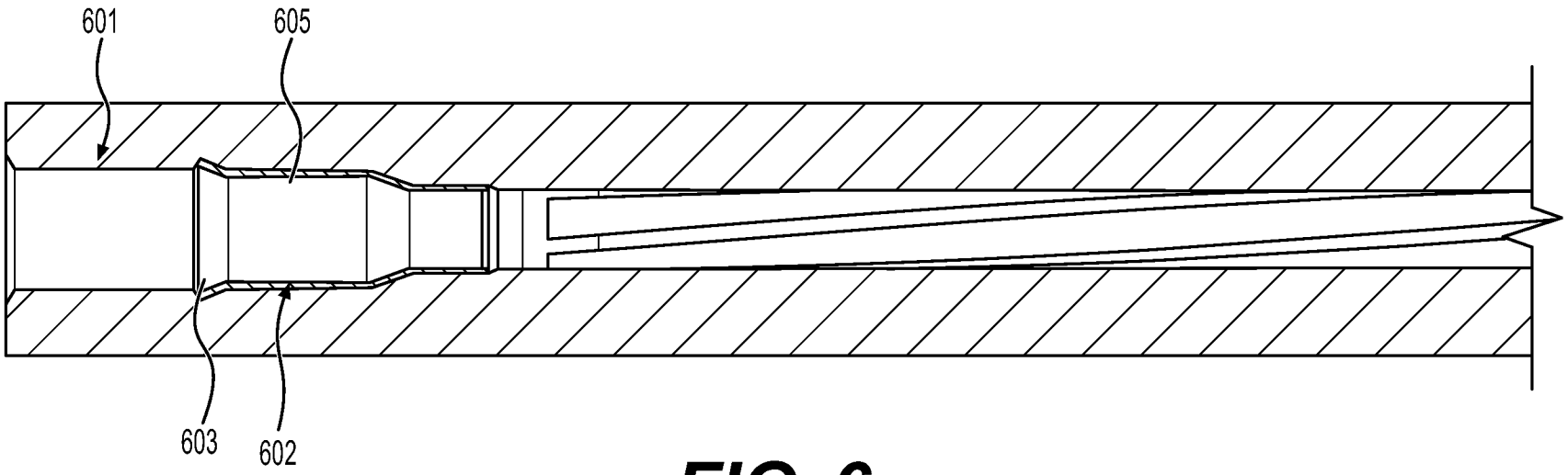
FIG. 6 shows a side section view of the remaining portion of a standard cartridge case confined in the inventive chamber after firing and case extraction.

FIG. 6 shows a side section view of the remaining portion 605 of a standard cartridge case 602 confined in the inventive chamber 601 after firing and case extraction. When a firearm containing the inventive chamber 601 performs case extraction of a full power round after firing, the rearward section of the case 506 (as shown in FIG. 5) is extracted, while the forward section 605 is trapped within the relief feature 603, which serves as a physical impediment preventing subsequent cartridges of any type from being chambered and fired.

Figure 7:
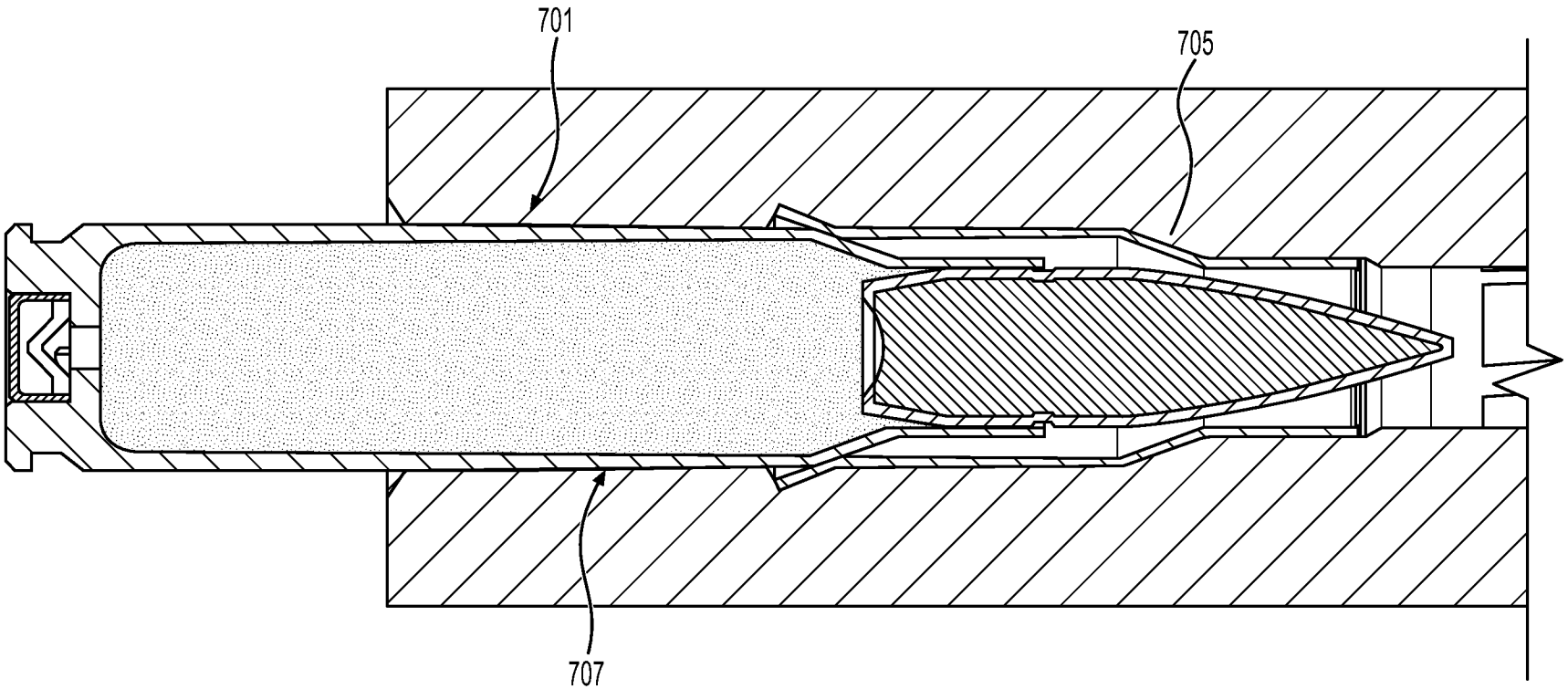
FIG. 7 shows a side section view of an unsuccessful attempt to chamber a subsequent cartridge with the forward section of a cartridge case confined in the inventive chamber after firing and case extraction.

FIG. 7 shows a side section view of an unsuccessful attempt to chamber a subsequent cartridge 707 with the forward section 705 of a cartridge case confined in the inventive chamber 701 after firing and case extraction. When the forward section 705 of a cartridge case becomes trapped within the inventive chamber 701, as described above, it causes a severe weapon malfunction that is not correctable by the operator. The malfunction and trapped forward section 705 of the previously fired cartridge case serves as a physical impediment preventing proper chambering or firing of any subsequent cartridges 707. More specifically, the forward section 705 of the cartridge case occupies the inventive chamber 701, and prevents the subsequent cartridge 707 from being fully seated therein. As such, the breech bolt remains in an out-of-battery position and unable to fire. As the forward section 705 of the cartridge is trapped, no standard malfunction clearance techniques will be capable of removing the forward section 705, thereby rendering the firearm incapable of fire subsequent rounds.

Figure 8A:
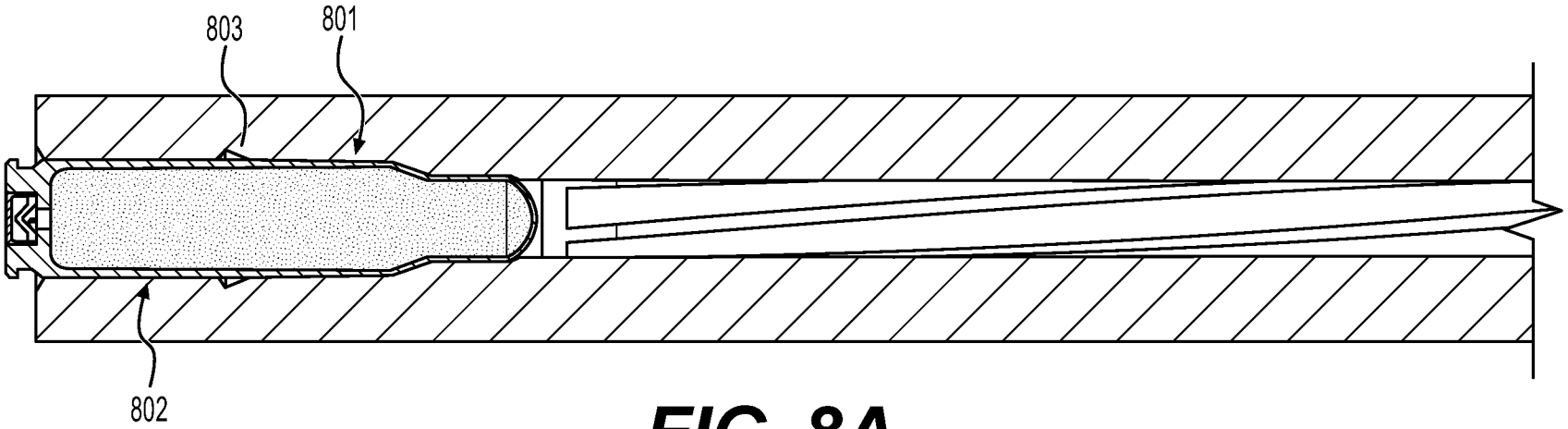
FIG. 8A shows a side section view of a blank cartridge chambered in the inventive chamber before firing.

FIG. 8A shows a side section view of a blank cartridge 802 chambered in the inventive chamber 801 before firing. When a low powered cartridge, such as a training or blank cartridge 802 is fired from the inventive chamber 801, the firearm operates in a normal manner as if the blank training ammunition were being loaded and fired in a conventional cartridge chamber. In other words, the blank rounds do not behave any differently in the inventive cartridge chamber 801 as compared to a standard prior art cartridge chamber.

Figure 8B:
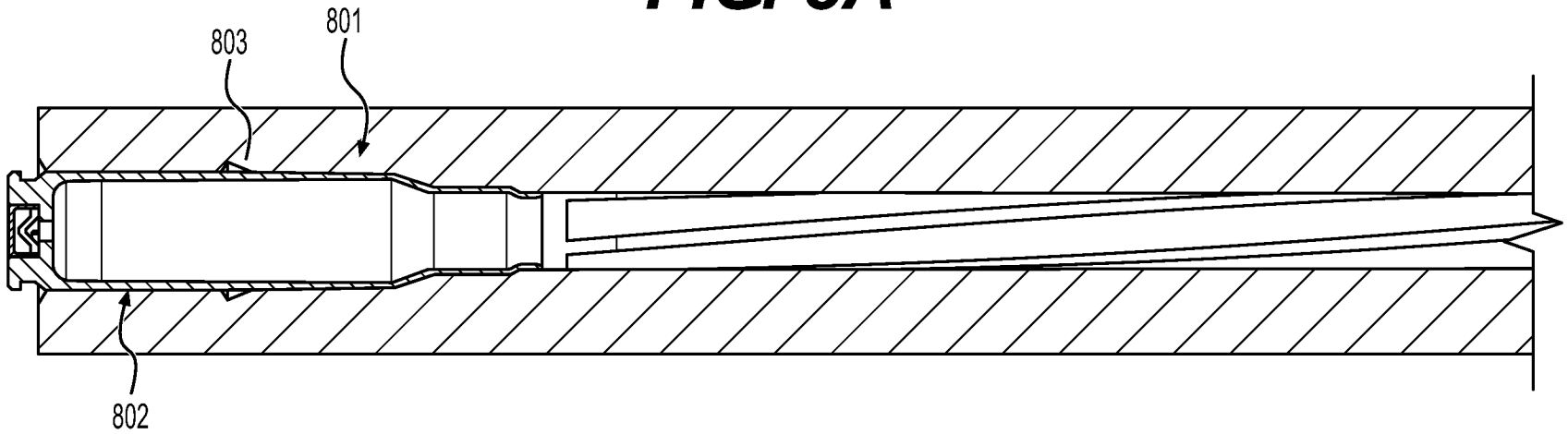
FIG. 8B shows a side section view of a blank cartridge chambered in the inventive chamber after firing.

FIG. 8B shows a side section view of a blank cartridge 802 chambered in the inventive chamber 801 after firing. As can be appreciated, a lower powered cartridge, such as a training or blank cartridge 802 does not create the same amount of pressure as that of a full power cartridge. The lower power prevents the blank cartridge 802 from deforming, filling the cavity formed by the relief 803, separating into forward and rearward casing sections, and causing a severe weapon malfunction. Instead, the blank cartridge 802 operates and cycles normally, allowing for subsequent firing of one or more blank cartridges. In this manner, the relief feature 803 of the inventive chamber 801 prevents continued operation of a firearm by trapping a portion of a first cartridge case within the cartridge chamber 801 when a first cartridge type is fired (i.e., a high pressure or standard combat cartridge), and permits continued operation of the firearm when a second cartridge type is fired (i.e., a low pressure or training cartridge).

The utility benefit being offered by the inventive cartridge chamber could potentially apply to numerous weapon systems of various calibers. Due to the safety benefits, the inventive cartridge chamber could potentially find use in other less obvious applications as well such as the entertainment/movie industry that regularly relies on the use of blank ammunition when firing weapons during filming.

Additionally, the inventive cartridge chamber could be used to differentiate between any two cartridge types that operate at significantly different peak pressures and to the benefit of operator safety even if one of the two types of ammunition is not a blank training round. Non-limiting examples include a single chamber configuration that can accept different cartridge types (.38 Special vs .357 Magnum, high vs low brass vs magnum shotgun shells, and the like.). In some cases, the firearm is not capable of repeated firings of the higher-pressure cartridge even if the chamber geometry allows for such rounds to be loaded and fired. The inventive cartridge chamber thereby limits the number of unwanted firings to only one, aiding to the safety benefit of the operator and those in close proximity.

The cartridge chamber can also differentiate between different cartridge types even if they operated at similar or identical peak pressures if the cartridge case structural characteristics (such as sectional geometry, material, and/or strength) associated with each unique cartridge type are sufficiently different. Continued investment in the development of polymer and other non-standard cartridge case material alternatives may allow this scenario to unfold for applications of the inventive cartridge chamber in future use. Also, while the concept was initially conceived and subsequently designed and demonstrated in a small caliber training weapon, its general applicability is not limited to small caliber weapons.

While not an object of the invention nor a requirement for implementing the inventive cartridge chamber, it is readily achievable in practice to utilize the inventive chamber with an additional safety device, such as one designed to capture the bullet from a fired combat cartridge and not allow it to travel downrange. That can easily be accomplished by way of a robust blank firing attachment (BFA), which is typically a muzzle-mounted device on end of a gun barrel used when firing blank ammunition to generate sufficient backpressure (in the absence of a bullet) to automatically cycle the operating group of the training weapon. A BFA often serves a secondary duty as a bullet trap, capturing one or more bullets from fired combat cartridges and preventing them from exiting the barrel before the BFA succumbs to structural failure.

There are a number of possible permutations to the preferred embodiment that would still fall under the utility umbrella of the inventive cartridge chamber. The general utility of the inventive cartridge chamber includes its ability to passively leverage peak operating pressure differences between different types of cartridges for the purpose of selectively facilitating material deformation of the cartridge case after firing for the purpose of inducing a severe malfunction that renders the weapon unusable for further firing. The ability to differentiate between cartridge types is not limited to standard combat and blank training cartridges only. Any varying type(s) of ammunition that operate with a sufficient peak pressure delta could be selectively discriminated by way of the inventive cartridge chamber. It is conceivable that certain medium caliber weapon systems may also benefit. Some examples of alternative embodiments, which deviate from the illustrated preferred embodiment, are included below.

- Circumferential relief geometry of a different groove profile (such as a square groove, full radius groove).
- Utilizing additional circumferential relief features in combination in the same or different areas of the cartridge chamber.
- Utilizing discrete relief features that are not fully circumferential (such as holes, dimples, counterbores, countersinks, segmented radial grooves, longitudinal grooves).
- Utilizing helical relief/groove features (not unlike a screw thread form, could be single or multi-start).
- Utilizing opposing helical relief/groove features (not unlike knurling)

Incorporating any of the above by way of an additional component insert or inserts in the cartridge chamber (e.g., not incorporated integrally in the existing cartridge chamber).

Utilizing a cartridge chamber material, or material insert, of inferior mechanical properties (itself designed to fail at a certain pressure) either with or without any additional relief features.

It is also important to note that despite the illustrations showing the preferred embodiment being implemented on a centerfire rifle sized bottleneck cartridge, the inventive cartridge chamber is not limited to use in bottleneck applications or rifles. The concept is fundamentally applicable to use in handguns, rifles, machine guns, or shotguns chambered for any general cartridge configuration type (e.g., bottleneck, straight-walled, tapered, and the like) of centerfire and/or rimfire types.

We claim:

1. A firearm cartridge chamber system, comprising:

a higher pressure cartridge comprising a higher pressure cartridge case;

a lower pressure cartridge comprising a lower pressure cartridge case;

a relief feature incorporated into said cartridge chamber that forms a cavity;

wherein said cavity overlaps said higher pressure cartridge case when inserted into said chamber; and wherein said cavity overlaps said lower pressure cartridge case when inserted into said chamber said chamber;

wherein firing of said higher pressure cartridge causes said higher pressure cartridge case to deform into said cavity and to be trapped within said chamber, causing said firearm to malfunction and preventing chambering and firing of any subsequent cartridges;

wherein a portion of said higher pressure cartridge case deforms, at least partially ruptures, and partially expands into said cavity when said higher pressure cartridge case is fired by said firearm; and wherein firing of said lower pressure cartridge does not prevent chambering or firing of any subsequent cartridges.

2. The apparatus of claim 1, wherein said higher pressure cartridge case deforms and separates into two sections, leaving a forward section of said higher pressure cartridge case separated entirely from a rearward section of said higher pressure cartridge case and trapped within said cavity.

3. The apparatus of claim 1, wherein said higher pressure cartridge case, once deformed, creates a firearm malfunction by preventing chambering or firing of any subsequent cartridges.

4. The apparatus of claim 3, wherein said firearm malfunction is not correctable by an operator without the use of tools or disassembly of the firearm.

5. The apparatus of claim 1, wherein in said relief feature is selected from the group consisting of a circumferential groove, a partial circumferential groove, dimple, hole, slot, knurling, and a helical groove of continuous or interrupted geometry.

6. A firearm and a firearm cartridge chamber system comprising:

a higher pressure cartridge comprising a higher pressure cartridge case;

a lower pressure cartridge comprising a lower pressure cartridge case;

a relief feature incorporated into said cartridge chamber that forms a cavity;

wherein said cavity overlaps said higher pressure cartridge case when inserted into said chamber; and wherein said cavity overlaps said lower pressure cartridge case when inserted into said chamber said chamber;

wherein firing of said higher pressure cartridge in said firearm causes said higher pressure cartridge case to deform into said cavity, at least partially rupture, and be trapped within said chamber, causing said firearm to malfunction and preventing chambering and firing of any subsequent cartridges; and wherein firing of said lower pressure cartridge in said firearm does not prevent chambering or firing of any subsequent cartridges.

7. The apparatus of claim 6, wherein said higher pressure cartridge is a live cartridge including one or more projectiles.

8. The apparatus of claim 6, wherein said lower pressure cartridge is a training or blank cartridge.

9. The apparatus of claim 6, wherein a portion of said higher pressure cartridge case from said higher pressure cartridge deforms and partially expands into said cavity when said higher pressure cartridge is fired by said firearm.

10. The apparatus of claim 6, wherein said higher pressure cartridge case from said higher pressure cartridge deforms and separates into two sections, leaving a forward section of said higher pressure cartridge case separated entirely from a rearward section of said higher pressure cartridge case and trapped within said cavity.

11. The apparatus of claim 6, wherein said higher pressure cartridge case, once deformed, creates a firearm malfunction by preventing chambering or firing of any subsequent cartridges.

12. The apparatus of claim 11, wherein said firearm malfunction is not correctable by an operator without the use of tools or disassembly of the firearm.

13. The apparatus of claim 6, wherein in said relief feature is selected from the group consisting of a circumferential groove, a partial circumferential groove, dimple, hole, slot, knurling, and a helical groove of continuous or interrupted geometry.

14. A firearm cartridge chamber system comprising:

a higher pressure cartridge comprising a higher pressure cartridge case;

a lower pressure cartridge comprising a lower pressure cartridge case;

one or more relief features incorporated into said cartridge chamber that forms a cavity wherein firing of said higher pressure cartridge causes said higher pressure cartridge case to deform into said cavity;

wherein said higher pressure cartridge case separates into two sections, leaving a forward section of said case trapped within said cavity;

wherein said trapped forward section creates a firearm malfunction by preventing chambering and firing of any subsequent cartridges;

wherein said firearm malfunction is not correctable by an operator without the use of tools or disassembly of the firearm;

wherein firing of said lower pressure cartridge does not prevent chambering or firing of any subsequent cartridges.

15. The apparatus of claim 14, wherein in said relief feature is selected from the group consisting of a circumferential groove, a partial circumferential groove, dimple, hole, slot, knurling, and a helical groove of continuous or interrupted geometry.

* * * * *